US007740055B2

(12) United States Patent
Wung et al.

(10) Patent No.: US 7,740,055 B2
(45) Date of Patent: Jun. 22, 2010

(54) FAN HOLDER

(75) Inventors: Shin-Hsuu Wung, Tu-Cheng (TW); Jian Hu, Shenzhen (CN); Ling-Bo Cao, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, Taipei Hsien (TW)

( * ) Notice: Subject to any disclaimer, the term of this patent is extended or adjusted under 35 U.S.C. 154(b) by 1351 days.

(21) Appl. No.: 11/114,543

(22) Filed: Apr. 26, 2005

(65) Prior Publication Data

US 2006/0045737 A1 Mar. 2, 2006

(30) Foreign Application Priority Data

Aug. 31, 2004 (CN) ..... 2004 2 0083683 U

(51) Int. Cl.
*H05K 7/20* (2006.01)

(52) U.S. Cl. ..... 165/121; 165/80.3; 361/697; 415/213.1

(58) Field of Classification Search ..... 165/80.3, 165/121, 122; 361/697; 415/213.1
See application file for complete search history.

(56) References Cited

U.S. PATENT DOCUMENTS 1,270,296 A * 6/1918 Edwin ..... 248/345
5,287,249 A * 2/1994 Chen ..... 361/718
5,409,352 A * 4/1995 Lin ..... 415/177
5,421,402 A * 6/1995 Lin ..... 165/80.3
5,445,215 A * 8/1995 Herbert ..... 165/80.3
5,452,181 A * 9/1995 Hoover ..... 361/697
5,457,342 A * 10/1995 Herbst, II ..... 257/712
5,484,013 A * 1/1996 Morikawa et al. ..... 165/80.3
5,484,262 A * 1/1996 Thomas et al. ..... 415/178
5,502,619 A * 3/1996 Wang ..... 361/697
5,542,579 A * 8/1996 Robbins, III ..... 222/158
5,545,009 A * 8/1996 Ke ..... 416/95
5,582,506 A * 12/1996 Hong ..... 415/177
5,583,746 A * 12/1996 Wang ..... 361/697
5,594,623 A * 1/1997 Schwegler ..... 361/697
5,615,998 A * 4/1997 Kodama et al. ..... 415/177
5,677,829 A * 10/1997 Clemens ..... 361/697
5,788,068 A * 8/1998 Fraser et al. ..... 206/310
5,788,566 A * 8/1998 McAnally et al. ..... 454/184
5,931,294 A * 8/1999 Weingarden et al. ..... 206/308.1

(Continued)

FOREIGN PATENT DOCUMENTS

DE 3625421 A * 2/1988

(Continued)

*Primary Examiner*—Allen J Flanigan
(74) *Attorney, Agent, or Firm*—Frank R. Niranjan

(57) ABSTRACT

A fan holder is used for securing a fan to a heat sink. The fan holder includes a cover mounting the fan thereon, and a base mounting the cover thereon. The cover includes a plurality of separate claws and at least one jut. The base includes a through hole receiving the claws of the cover therein, thereby rotatably mounting the cover onto the base, and at least one slot. The at least one slot has a first pit and a second pit at two ends thereof respectively. The at least one jut is slidable along the slot between the first pit and the second pit to have the cover rotatable between a first location and a second location.

14 Claims, 3 Drawing Sheets

U.S. PATENT DOCUMENTS

| | | | | |
|---|---|---|---|---|
| 6,206,087 | B1 * | 3/2001 | Nakase et al. | 165/80.3 |
| 6,240,247 | B1 * | 5/2001 | Reiker | 392/364 |
| 6,341,644 | B1 | 1/2002 | Lo et al. | |
| 6,386,276 | B1 * | 5/2002 | Chen et al. | 165/121 |
| 6,392,885 | B1 | 5/2002 | Lee et al. | |
| 6,520,250 | B2 | 2/2003 | Lee et al. | |
| 6,552,464 | B1 * | 4/2003 | Rahbar et al. | 310/239 |
| 6,650,541 | B1 * | 11/2003 | Simon et al. | 361/697 |
| 6,662,411 | B2 * | 12/2003 | Rubenstein et al. | 24/453 |
| 7,117,932 | B2 * | 10/2006 | Ku et al. | 165/121 |
| 7,286,350 | B2 * | 10/2007 | Lee et al. | 361/695 |
| 7,369,408 | B2 * | 5/2008 | Chang | 361/697 |
| 2002/0011326 | A1 * | 1/2002 | Matsumoto | 165/80.3 |
| 2002/0081107 | A1 * | 6/2002 | Reiker | 392/364 |
| 2002/0088606 | A1 * | 7/2002 | Wei | 165/80.3 |
| 2002/0188288 | A1 * | 12/2002 | Abboud et al. | 606/21 |
| 2004/0037704 | A1 * | 2/2004 | Cichetti et al. | 416/246 |

FOREIGN PATENT DOCUMENTS

| | | | |
|---|---|---|---|
| JP | 01185144 | A * | 7/1989 |
| JP | 01190232 | A * | 7/1989 |
| TW | 405720 | | 9/2000 |
| TW | 585386 | | 4/2004 |

* cited by examiner

FAN HOLDER

BACKGROUND

1. Field

This invention is related to fan holders, and particularly to a fan holder corresponding to electronic components.

2. Prior Art

Electronic components such as central processing units (CPUs) frequently generate large amounts of heat during normal operation. Such heat can adversely affect the operational stability of the electronic components, therefore a heat sink is used to dissipate heat generated by the electronic component. A fan is often attached to the heat sink to provide forced air convection to the heat sink.

Conventionally, a heat sink is fastened on the electronic components via fasteners located at four corners of the heat sink. The dimension defined by the four corners of the heat sink is close to that of a frame of a fan mounted on the heat sink. As a result, the frame of the fan shields the space above the four corners for locating the fasteners. So that, assembly or disassembly of the heat sink is interfered.

What is needed therefore, is a fan holder for mounting a fan onto a heat sink without interference when assembling or disassembling the heat sink.

SUMMARY

A fan holder of a preferred embodiment of the present invention comprises a base and a cover. The base comprises means for securing the fan holder. The cover is mounted onto the base for holding a fan thereon, and parallelly rotatable on the base between a first location and a second location.

Other advantages and novel features of the present invention will be drawn from the following detailed description of preferred embodiments of the present invention with the attached drawings, in which:

DETAILED DESCRIPTION OF THE EMBODIMENT

Figure 1:
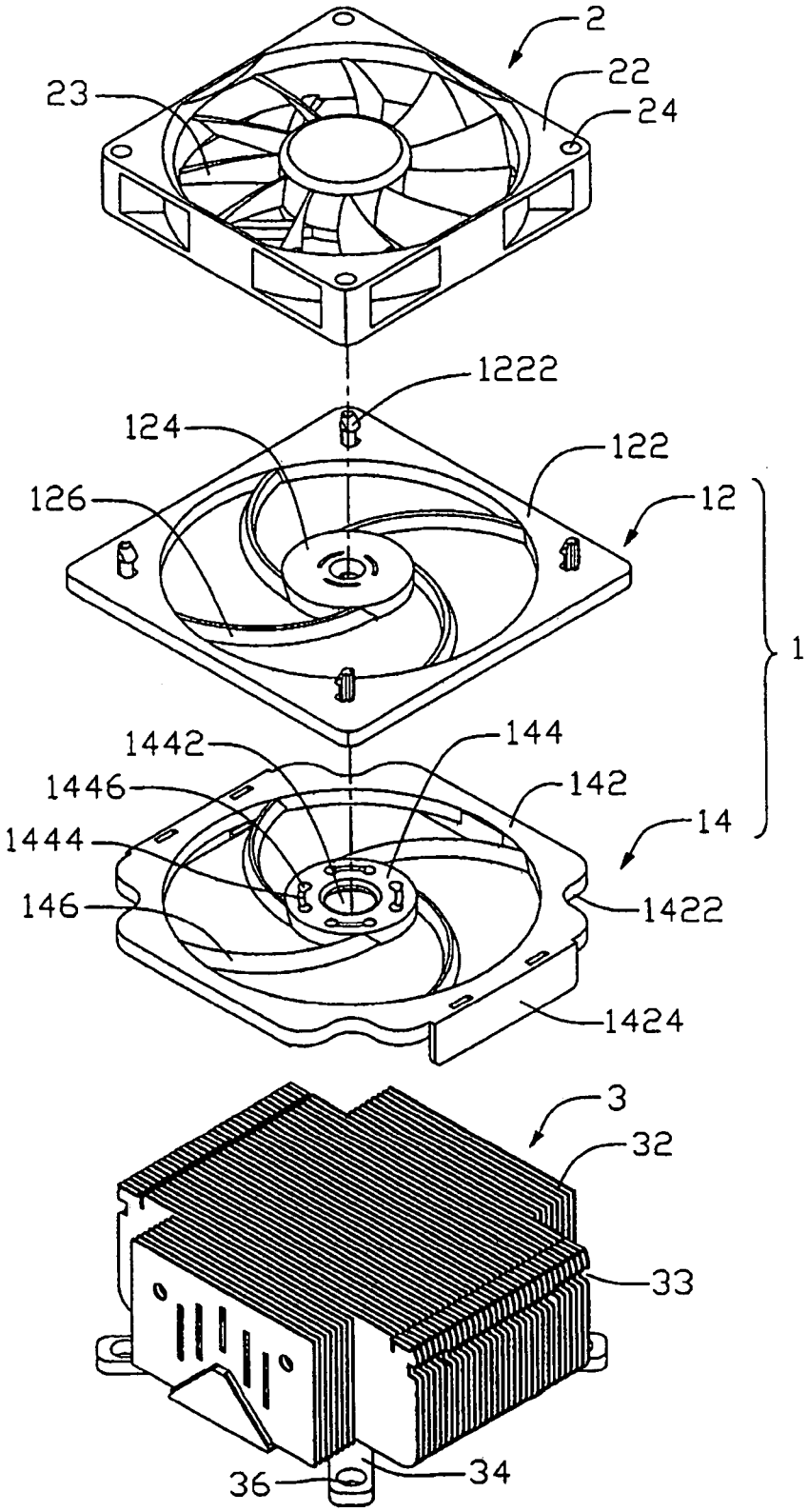
FIG. 1 is an exploded view of a fan holder in accordance with a preferred embodiment of the present invention, and a heat sink and a fan.

Referring to FIG. 1, a fan holder 1 for mounting a fan 2 onto a heat sink 3 of a heat dissipation device is shown. The fan holder 1 comprises a cover 12 and a base 14 beneath the cover 12. The fan 2 comprises a rectangular bracket 22 defining four through holes 24 at four corners thereof, and an impeller 23 located in the bracket 22. The heat sink 3 comprises a plurality of fins 32. A pair of grooves 33 is defined in an upper end of the fins 32 at two opposite sides of the heat sink 3. Four arms 34, each of which defines a through hole 36 at a tip thereof, are formed at diagonal corners of the heat sink 3. The heat sink 3 can be securely mounted on an electronic component (not shown) by fasteners like screws matching with the through holes 36.

Figure 2:
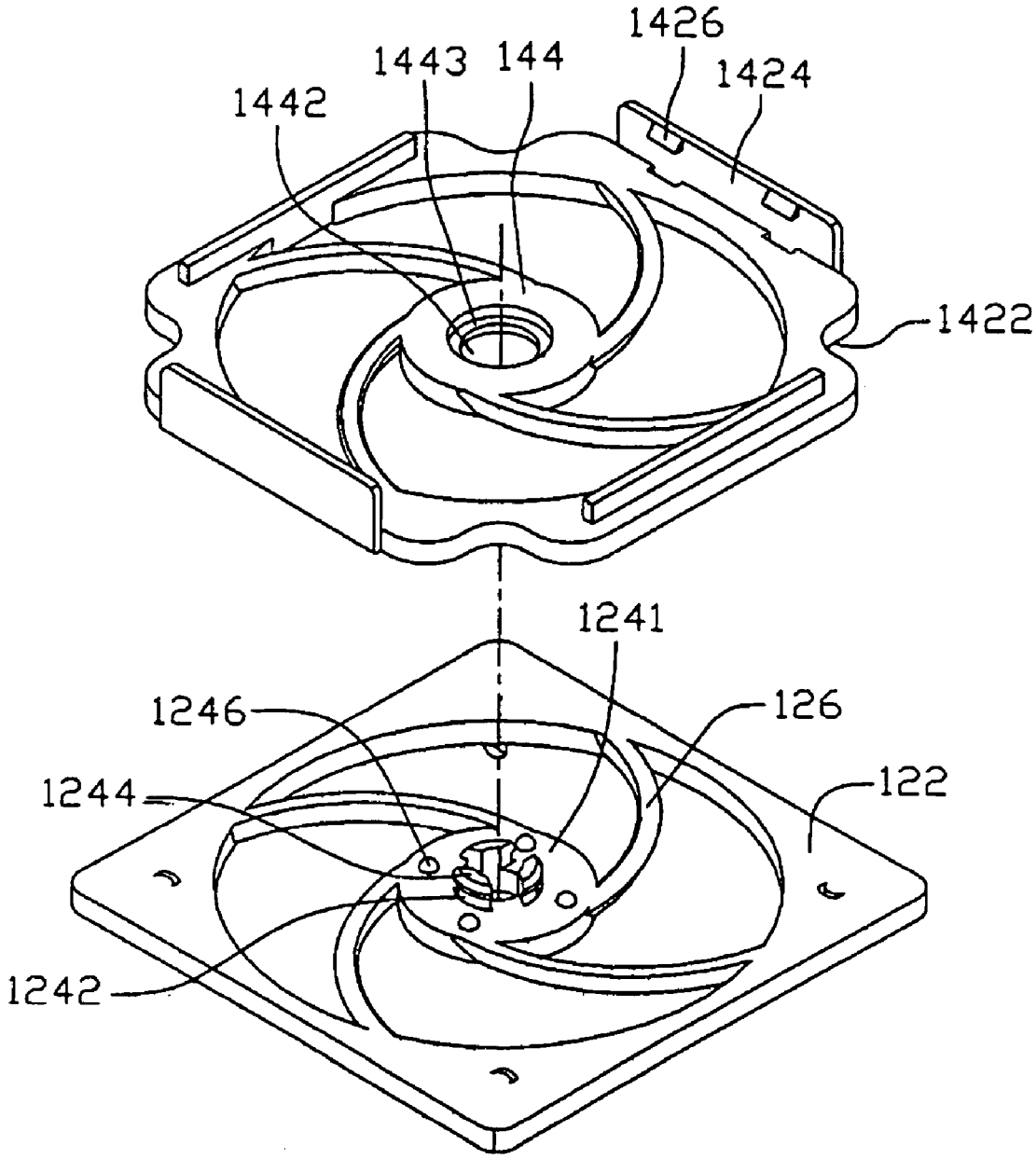
FIG. 2 is an inverse exploded view of the fan holder of FIG. 1.

Referring also to FIG. 1 and FIG. 2, the cover 12 comprises a rectangular first frame 122. An aperture (not labeled) is defined in a substantial center of the first frame 122, for airflow from the fan 2 passing therethrough. A first fixing portion 124 is disposed in a substantial center of the aperture. Pluralities of rotational ribs 126 connect the first fixing portion 124 and an inner wall of the first frame 122, and uniformly spread between the first frame 122 and the first fixing portion 124. Four columns 1222, each of which forms a clasp (not labeled) at an upper end thereof, extend upwardly from four corners of the first frame 122 respectively. The fixing portion 124 comprises a fixing board 1241, three separate claws 1242 and four juts 1246. The claws 1242, each of which has a hook 1244 at an end thereof, perpendicularly extend from a center of the fixing board 1241. The juts 1246 project from the fixing portion 124 evenly and around the claws 1242.

The base 14 comprises a second frame 142 defining an opening (not labeled), corresponding to the aperture of the cover 12, at a substantial center thereof, for airflow from the fan 2 passing therethrough. A second fixing portion 144, corresponding to the first fixing portion 124 of the cover 12, is disposed in a substantial center of the opening. Pluralities of rotational ribs 146 connect the second fixing portion 144 and an inner wall of the second frame 142, and distribute evenly between the frame 142 and the second fixing portion 144. A through hole 1442 is defined in a center of the second fixing portion 144, for receiving the claws 1242 of the first fixing portion 124. The diameter of an upside of the hole 1442 is smaller than that of a downside of the hole 1442, thereby forming a circular step 1443 between the upside and the downside, abutted against by the hooks 1244 of the claws 1242. Four curved slots 1444, corresponding to the juts 1246 of the first fixing portion 124, are defined in an upper surface of the second fixing portion 144. A first pit 1446 and a second pit 1446 are defined respectively at two ends of each slot 1444, for receiving the corresponding jut 1246 of the first fixing portion 122 therein. Each corner of the second frame 142 defines a cutout 1422 corresponding to the through holes 36 of the heat sink 3. Two plates 1424 depend from two opposite sides of the second frame 142 corresponding to the grooves 33 of the heat sink 3. At least one barb 1426 is formed at a foot of each plate 1424, hooking in the groove 33.

Figure 3:
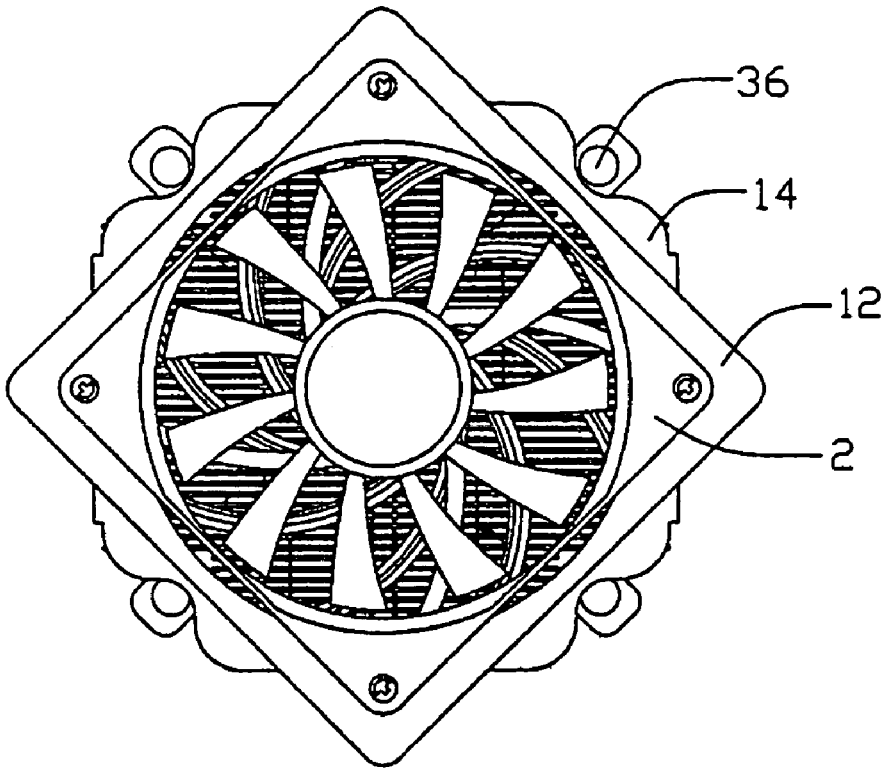
FIG. 3 is a planform of an assembly of FIG. 1.
Figure 4:
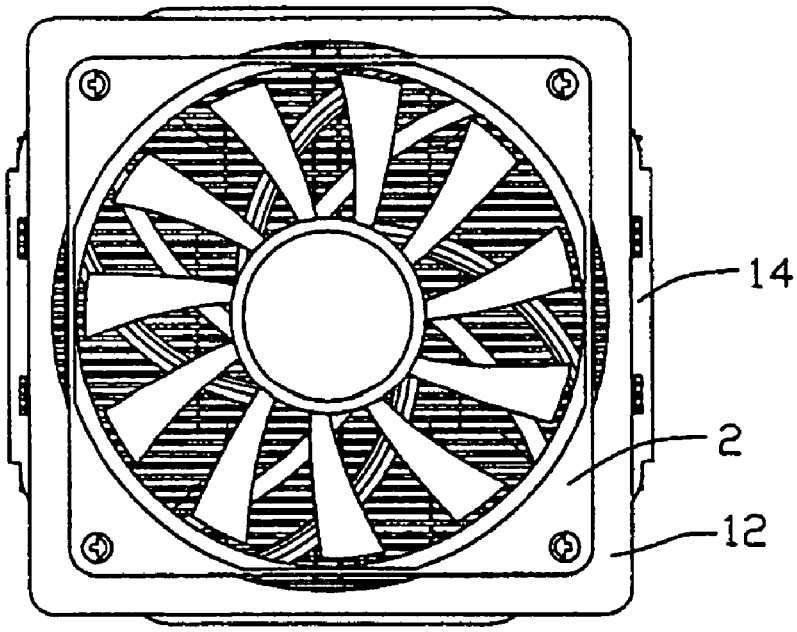
FIG. 4 is another planform of an assembly of FIG. 1.

Further referring to FIG. 3 and FIG. 4, an assembly of the fan holder 1, the fan 2 and the heat sink 3 is shown. The columns 1222 of the cover 12 are forced through the holes 24 of the fan 2, then the clasps of the columns 1222 clasp the fan 2, therefore the fan 2 is mounted on the cover 12. The base 14 is secured to the heat sink 3 via the barbs 1426 hooking in the grooves 33. The cover 12 is put on the base 14. The claws 1242 of the first fixing portion 124 of the cover 12 are elastically received in the hole 1442 of the second fixing portion 144 of the base 14, and the hooks 1244 of the claws 1242 abut against the step 1443 upwardly. Meanwhile, the juts 1246 are forced into the corresponding slots 1444 and localized into the first pits 1446. Here, as FIG. 3 showing, the cover 12 is assembled on the base 14, and the corners of the fan 2 and the cover 12 deviate from the cutouts 1422 of the base 14 so that the upper space above the holes 36 of the heat sink 3 is not sheltered. Therefore, assembly of the heat sink 3 can be expediently performed without any interference. Rotating the cover 12, each jut 1246 slides along the slot 1444 from the first pit 1446 to the second pit 1446, such that the corners of the fan 2 and the cover 12 are corresponding to the hole 36 of the heat sink 3. Here, according to FIG. 4, the assembly of the fan 2, the fan holder 1 and the heat sink 3 is accomplished.

Rotating the cover 12 of the fan holder 1 reversely, the disassembly of the heat sink 3 can be performed.

In the present invention, as a replacement, the claws 1242 project from the upper surface of the base 14, while the hole 1442 is defined in the cover 12. Also, the juts 1246 are formed on an upper surface of the base 14, while the slots 1444 and the pits 1446 are defined in a rear surface of the cover 12.

In accordance with this invention, the claws 1242 inserting into the hole 1442 has the cover 12 rotatablely parallelly mounted onto the base 14. The juts 1246 slidable along the slots 1444 between the first pits 1446 and the second pit 1446 has the cover 12 rotatable between a first location, when the juts 1246 are received in the first pits 1446, and a second location, when the juts 1246 are received in the second pits 1446. Thus, rotating the cover 12, the corners of the fan 2 and the cover 12 deviate from the upper space above the holes 36 of the heat sink 3, therefore, either assembly or disassembly of the heat sink 3 can be expediently performed without any interference. Additionally, the fan 2 is mounted on the cover 12 via the columns 1222 received in the hole 24 of the fan 2, thus, the assembly or disassembly of the fan 2 with the fan holder 1 is convenient. The base 14 is secured to the heat sink 3 via the barbs 1426 hooking the grooves 33 of the heat sink 3, thus, the assembly or disassembly of the fan holder 1 with the heat sink 3 is convenient.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. A fan holder, comprising:

a base comprising means for securing the fan holder, the base defining a through hole therein; and a cover mounted onto the base for holding a fan thereon, and parallelly rotatable on the base between a first location and a second location;

wherein the cover comprises a plurality of separate claws perpendicularly extending from the cover and elastically received in the through hole of the base to rotatably mount the cover onto the base; and wherein the cover comprises a frame, means for securing the cover to the base, and a plurality of rotational ribs positioned therebetween.

2. The fan holder of claim 1, wherein the plurality of separate claws are formed at a center of the cover.

3. The fan holder of claim 1, wherein the base defines at least one set of a first pit, a second pit, and a curved slot connecting the first pit and the second pit, and wherein the cover forms at least one jut which is slidable along the slot between the first pit and the second pit to have the cover rotatable between the first location and the second location.

4. The fan holder of claim 3, wherein the cover is disposed at the first location when the jut is received in the first pit, and the cover is disposed at the second location when the jut is received in the second pit.

5. The fan holder of claim 1, wherein the base defines four cutouts at a periphery thereof so that the cutouts of the base and corners of the cover are alternately arranged and windows are formed through the cover and the cutouts when the cover is rotated to the first location.

6. The fan holder of claim 1, wherein the base forms two opposite plates, each of which forms at least one barb, for securing the base.

7. The fan holder of claim 1, wherein the cover forms four columns, each of which has a clasp at an end thereof, for securing the fan.

8. The fan holder of claim 1, wherein the base comprises a frame, means for securing the cover to the base, and a plurality of rotational ribs positioned therebetween.

9. A combination, comprising:

a heat sink defining through holes therein;

a fan; and a fan holder secured to the heat sink, comprising:

a cover mounting the fan thereon, the cover comprising a plurality of separate claws and at least one jut; and a base mounting the cover thereon, the base comprising a through hole receiving the claws of the cover therein, thereby rotatably mounting the cover onto the base, and at least one slot, having a first pit and a second pit at two ends thereof respectively, corresponding to the jut of the cover;

wherein, the jut is slidable along the slot between the first pit and the second pit to have the cover rotatable between a first location and a second location.

10. The combination of claim 9, wherein the heat sink comprises arms, each of which having the holes defined at a tip thereof, at diagonal corners thereof.

11. The combination of claim 9, wherein the base of the fan holder has a cutout at each corner thereof, corresponding to each said hole of the heat sink.

12. The combination of claim 9, wherein the heat sink defines two grooves at two opposite sides thereof, and wherein the base of the fan holder forms two opposite plates corresponding to the grooves, and each of the plates forms at least one barb hooking in the groove.

13. The combination of claim 9, wherein the fan defines four through holes at four corners thereof respectively, and wherein the cover of the fan holder forms four columns, each of which has a clasp at one end thereof, the clasps received in the corresponding holes of the fan and clasping the fan.

14. A heat dissipation device, comprising:

a heat sink used to retrieve heat and subsequently dissipating said heat;

a fan disposed next to said heat sink and workable to enhance said dissipating of said heat sink; and a fan holder disposed between said heat sink and said fan for holding said fan in position to be workable, said fan holder attachable to said heat sink and said fan respectively so that said fan has at least two movable positions relative to said heat sink;

wherein said fan holder comprises a base attachable to said heat sink, and a cover attachable to said fan and rotatably movable relative to said base so that said fan is capable of reaching said at least two movable positions thereof;

wherein said cover comprises a pronged portion which is inserted in said base to rotatably mount said cover onto said base; and wherein said cover comprises a plurality of hooks extending toward said base so as to engage with a step of said base in order for achieving rotatable movement of said cover relative to said base.

* * * * *